United States Patent [19]

da Silva

[11] Patent Number: 4,995,406

[45] Date of Patent: Feb. 26, 1991

[54] APPARATUS AND METHOD FOR OPENING A REEL OF PAPER STRIPPING

[75] Inventor: Domingos da Silva, Cortaillod, Switzerland

[73] Assignee: Fabriques de Tabac Reunies, S.A., Neuchatel, Switzerland

[21] Appl. No.: 316,224

[22] Filed: Feb. 27, 1989

[30] Foreign Application Priority Data

Feb. 25, 1988 [CH] Switzerland ..... 711/88

[51] Int. Cl.[5] ..... A24C 5/00; A24C 5/14

[52] U.S. Cl. ..... 131/105; 131/84.1; 242/58.4; 271/310

[58] Field of Search ..... 131/105, 84.1; 242/58.4, 58.1; 271/310, 900

[56] References Cited

U.S. PATENT DOCUMENTS 4,668,328 5/1987 Kyytsonen ..... 242/58.4 X 4,821,972 4/1989 Grollimund et al. ..... 242/58.4 X

FOREIGN PATENT DOCUMENTS 0189582 8/1986 European Pat. Off. .

0189761 8/1986 European Pat. Off. .

3523139 2/1987 Fed. Rep. of Germany ..... 131/105

*Primary Examiner*—V. Millin

*Assistant Examiner*—J. L. Doyle

*Attorney, Agent, or Firm*—Jeffrey H. Ingerman

[57] ABSTRACT

A carriage (6) is moved so that the periphery of a roller (4) rests against the reel (3). The blade (14) of a knife (5) cuts the closing belt of the reel and a few of the outer turns of the strip. The roller is started up so that the scraps are drawn into a device (8) by suction, the free end of the strip also entering this device. The suction device pivots downward so that the free portion of the strip comes to rest upon a presentation block (54) which has meanwhile been advanced.

12 Claims, 6 Drawing Sheets

Figure 1:
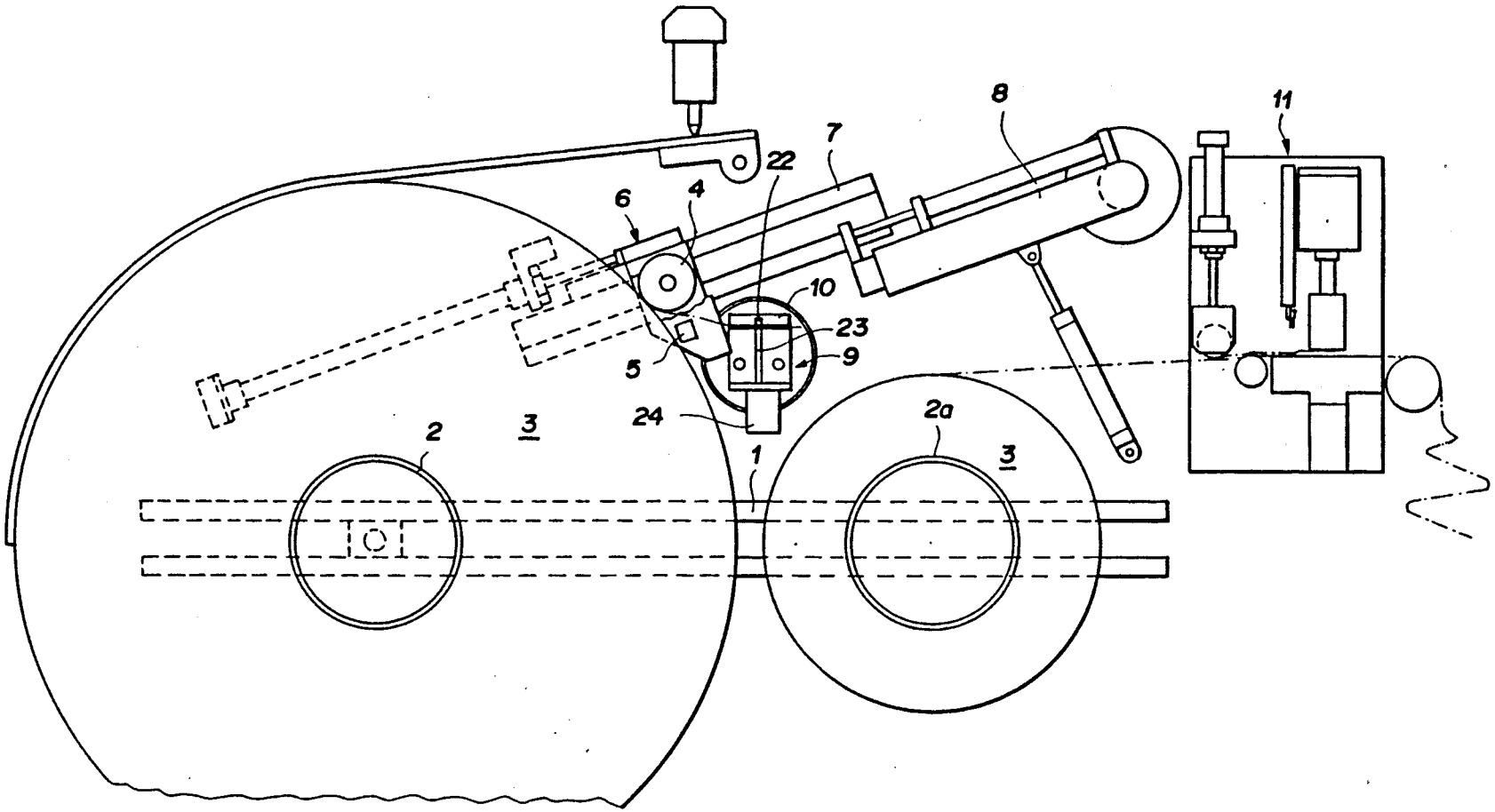

FIG. 2
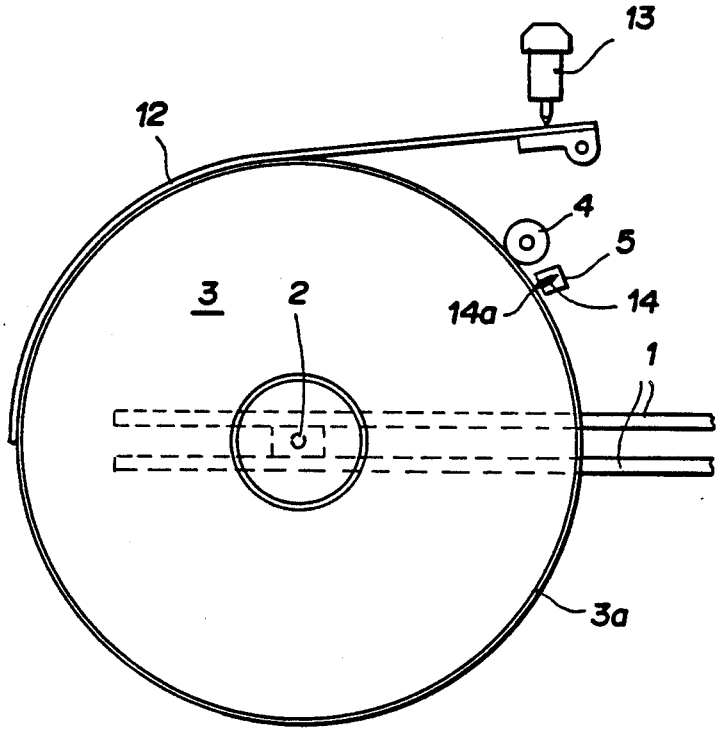
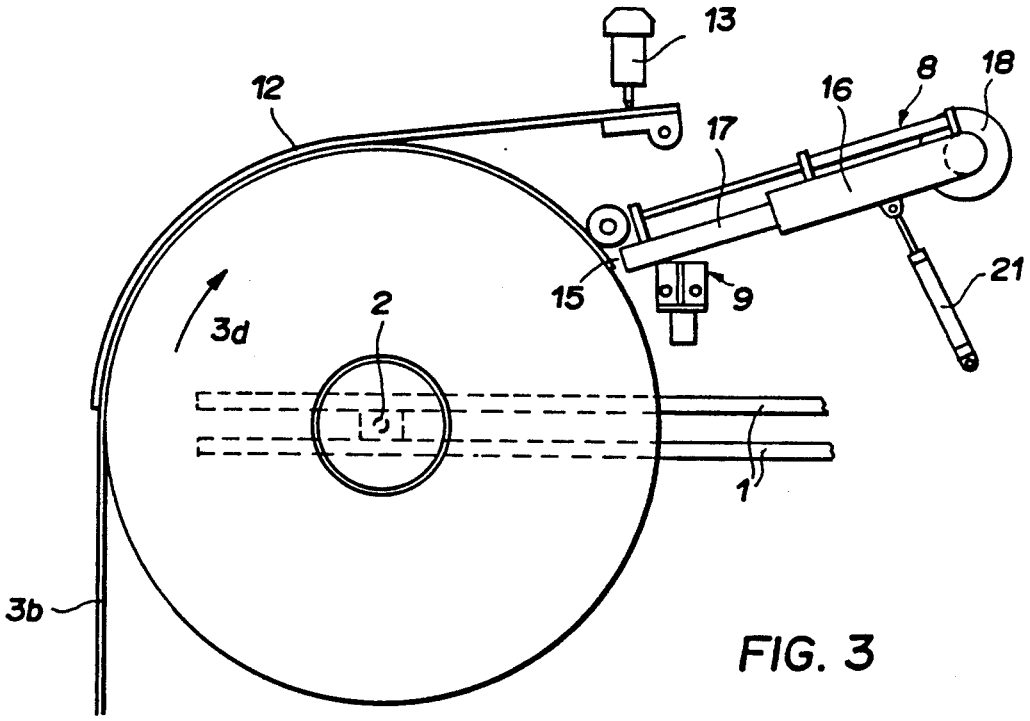
FIG. 3

50
49
48
47
30
53
52
15
17
54
9
55
51
37
3
59
16
23
57
24

APPARATUS AND METHOD FOR OPENING A REEL OF PAPER STRIPPING

This invention relates to manufacturing equipment, and more particularly to apparatus for opening a reel made of a strip of paper wound in successive turns and for engaging a leading end of the strip in a production machine.

The invention further relates to a method of opening a reel using the aforementioned apparatus.

In certain production machines, especially for manufacturing rods or filters in the cigarette industry, reels made of a strip of paper of standard width wound in successive turns are used. These reels must be installed one after the other at a certain location on the machine so as to unwind steadily as manufacture progresses. They are supplied in the form of closed reels, i.e., the end of the strip is glued to the preceding turn. Moreover, the circumference of the reel is generally encircled by a fairly thick ring of Bristol board to prevent inopportune unrolling of the strip. The inside or trailing end of the strip is usually supported on a core of predetermined diameter, likewise made of Bristol board or of plastic. When the reel is put in place, this core is fitted on a supporting mandrel forming part of the machine and driven by a motor.

The prior art, especially as represented by European patent applications Publication Nos. 0 189 761 and 0 189 582, includes apparatus which, once the reel is in place on its mandrel, detach and grasp the end of the strip by automatically controlled means, possibly after having cut it, in order to fix it to a conveyor intended to carry the leading end of the strip to the input of the machine.

However, these two prior art devices do not answer the practical requirements satisfactorily. First of all, in order for them to operate, any cardboard or plastic ring encircling the reels must be removed before the reel is mounted on its mandrel, and this operation cannot be mechanized. Furthermore, the end of the strip is detached by means of a scraper which sweeps over the periphery of the reel tangentially so as to strike against the glued end of the strip. The operation of this tool involves the risk of damaging the turn of the strip to which the end is glued.

It is an object of this invention to provide an improved apparatus and method for mechanizing the operations to be carried out on each reel from the time it is put in place on the mandrel until the leading end of the strip is grasped by a conveyor which then ensures its engagement in the machine, and for avoiding the drawbacks of the prior art apparatus while doing so.

To this end, the apparatus according to the present invention comprises means for supporting a rotary reel about a fixed axis at a predetermined location, a fixed slide bearing a movable carriage on which are mounted, on the one hand, a roller for driving the reel and, on the other hand, a knife having a straight edge, this edge and the axis of the roller being parallel to the axis of the reel, a suction and exhaust device having an inlet capable of being placed in proximity to the roller, and means for fixing a straightened leading end of the strip to a conveyor.

The method of operation according to the present invention comprises the steps of mounting the closed reel on a mandrel, cutting a peripheral zone of the reel along a line parallel to its axis, eliminating one or more cut segments and straightening the aforementioned leading end by suction, and fixing this straightened leading end to a conveyor means, all these operations being mechanized.

It should be noted that the engagement of the strip in the machine does not form part of the present invention. This operation may take place as described in the present assignee's co- pending application Ser. No. 268,975 or otherwise.

Figure 4:
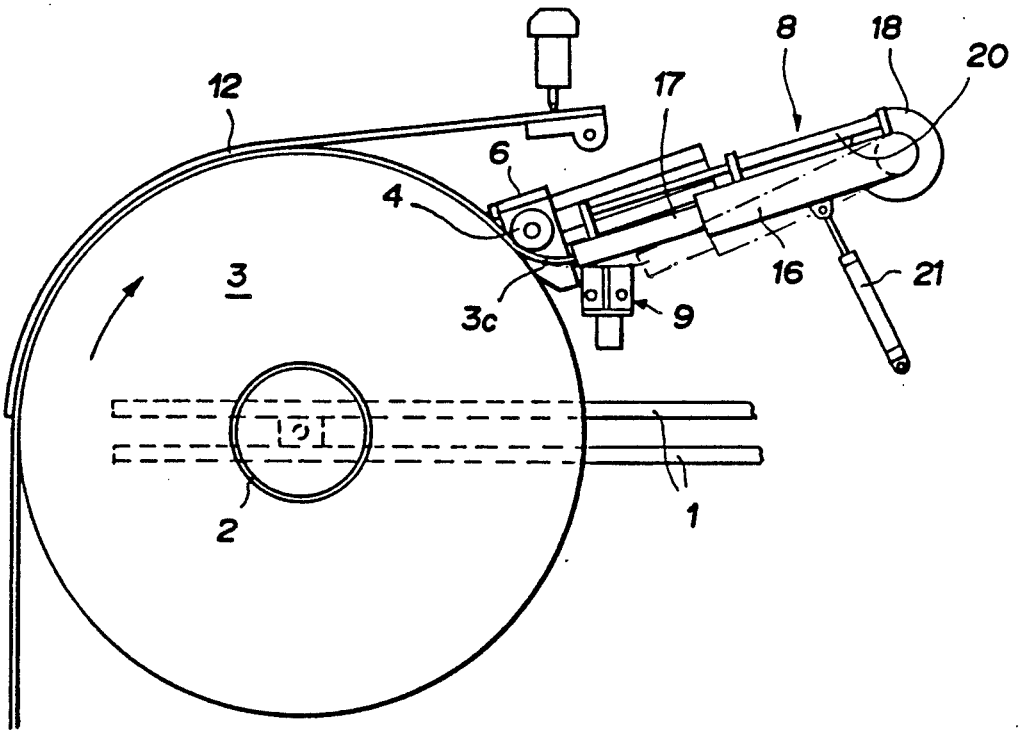
Figure 5:
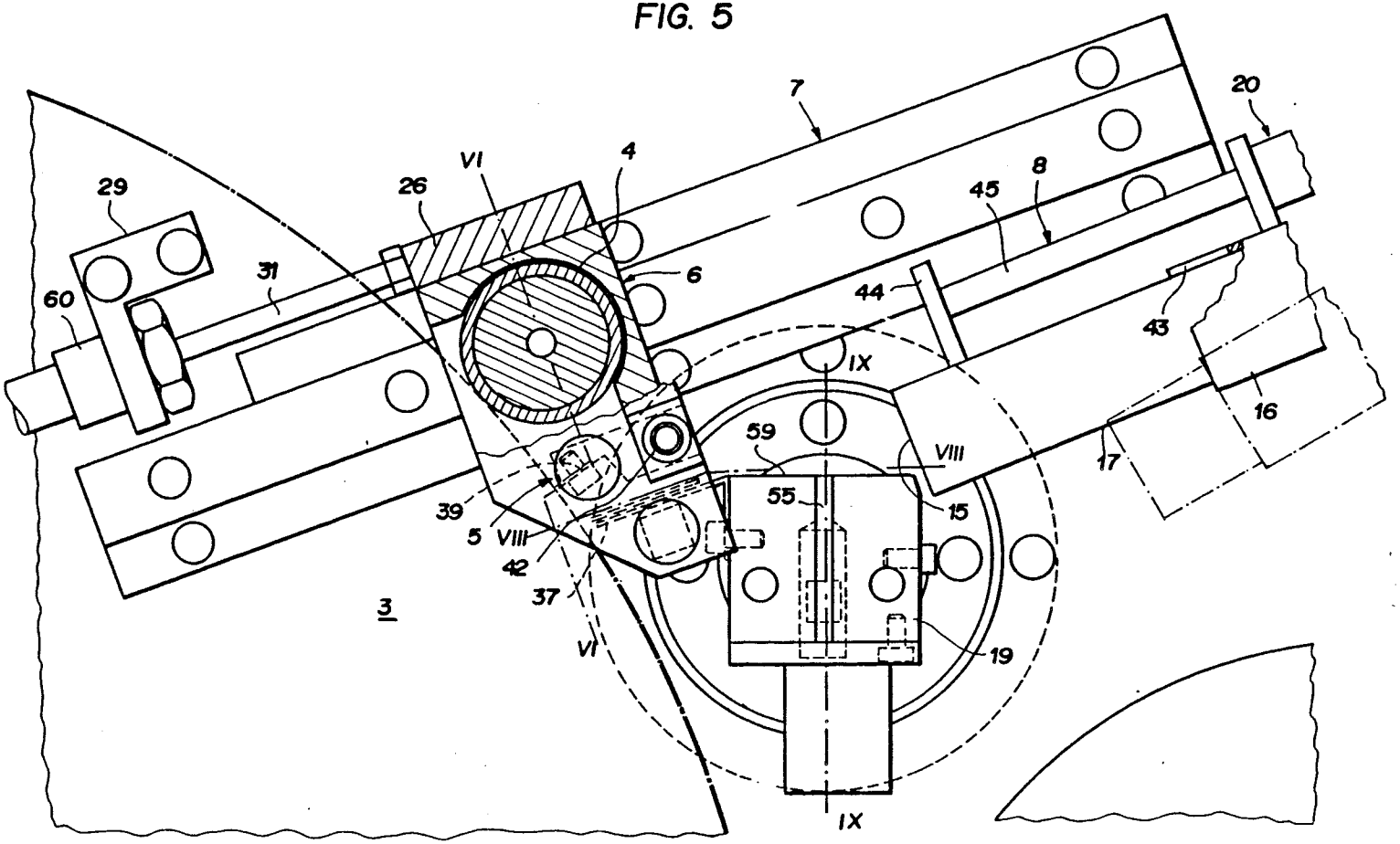
Figure 7:
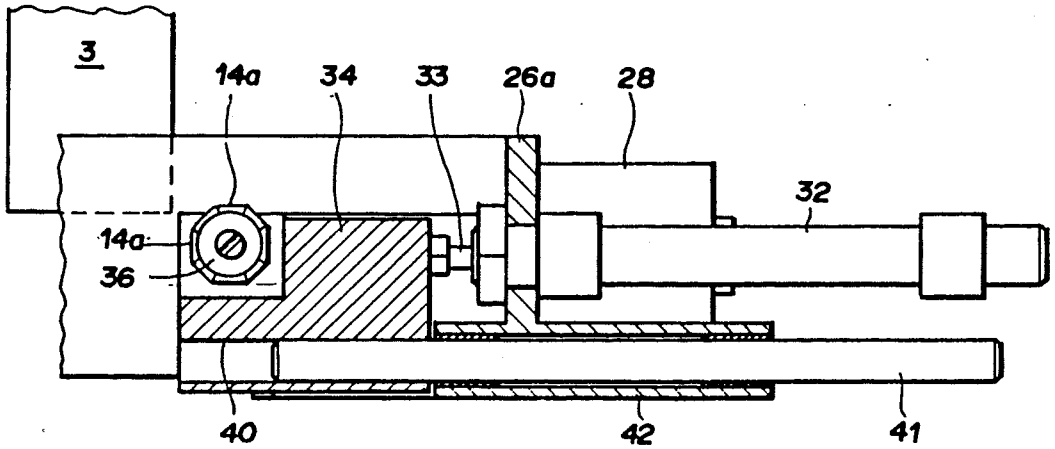
Figure 6:
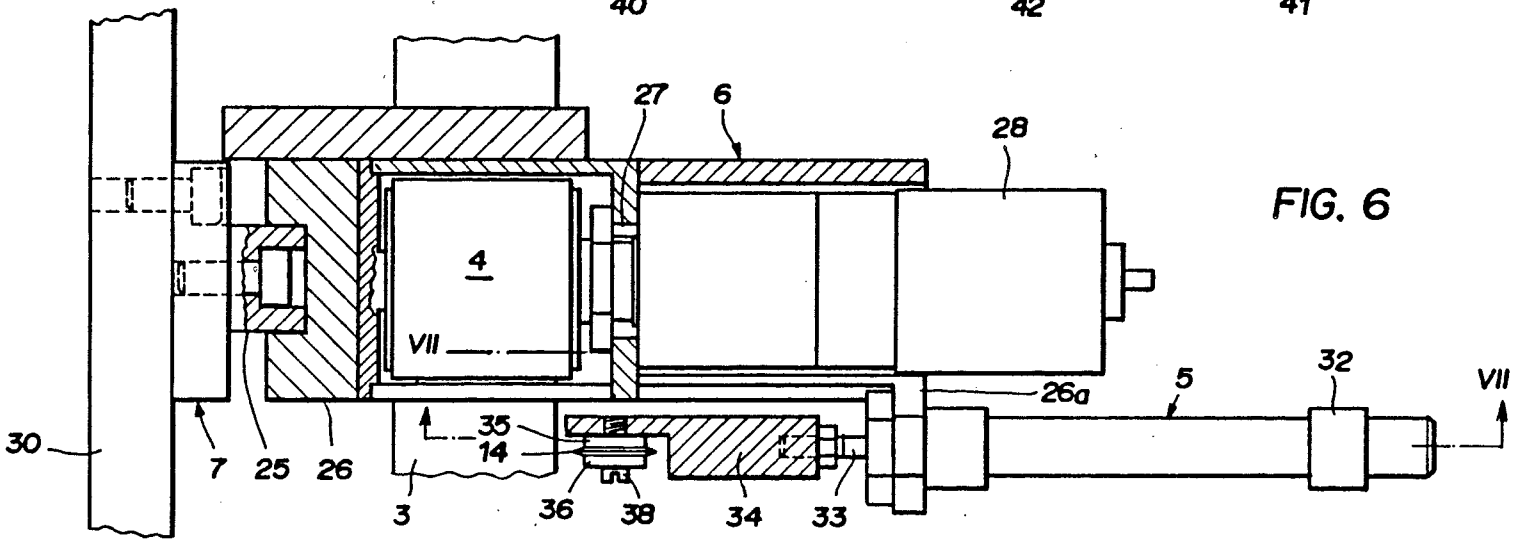
Figures 8, 9:
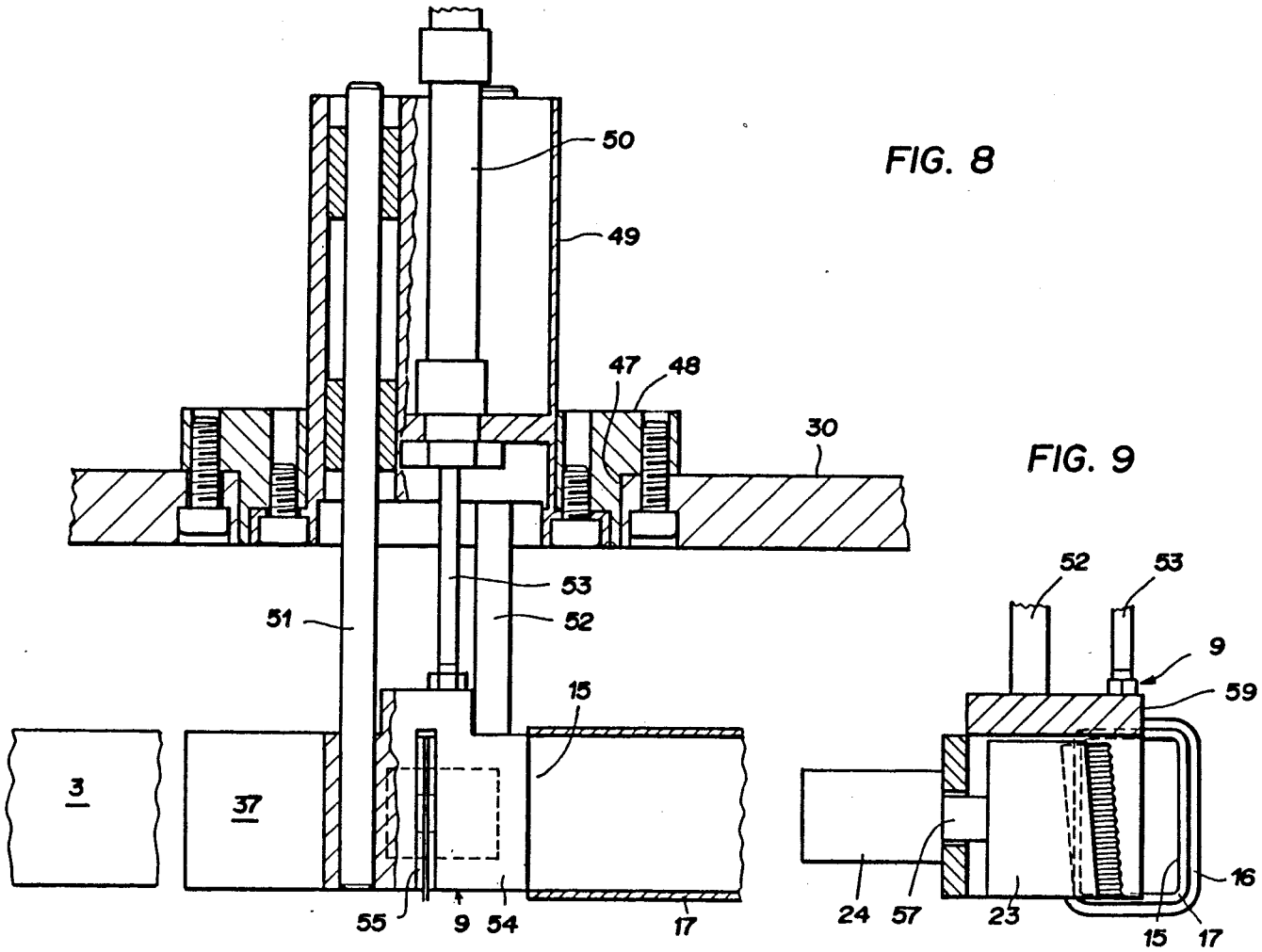

A preferred embodiment of the invention will now be described in detail with reference to the accompanying drawings, in which:

FIG. 1 is a simplified diagrammatic elevation of the main elements of the apparatus, FIGS. 2, 3, and 4 are partial elevations illustrating various steps of the method, FIGS. 5, 6, and 7 are partial elevations on a larger scale, partially in section, of the drive roller and the knife with their mounting and driving means, and FIGS. 8 and 9 are also partial elevations on a larger scale, partially in section, showing the means for presenting the straightened end of the strip.

The main elements of the apparatus are shown in FIG. 1. They include, firstly, a mandrel support 1 on which there is mounted a mandrel 2 bearing a closed reel 3 put in place beforehand. A drive roller 4 and a knife 5 are mounted on a carriage 6 movable on a slide 7 so that roller 4 can press against reel 3 and cause it to rotate about the axis of mandrel 2. A suction and exhaust device 8 is disposed in the vicinity of slide 7 so as to be able to discharge the pieces of the strip and fastenings cut off reel 3 and to straighten out the leading end of the strip. The latter may thus be caused to straighten out above a presentation component 9. This component is itself movable, as will be explained below, and fixes a surface portion of the strip to a movable suction nozzle 10 which belongs to a conveyor.

In the embodiment illustrated here, the conveyor cooperates with a joining device 11 shown on a small scale in FIG. 1 and described in the above-mentioned co-pending application Ser. No. 268,975. In this case, mandrel 2 is mounted on support 1 in such a way that it may be displaced, once joining has been effected, to take the place of mandrel 2*a*.

Summing up, the various steps of the method take place in the following manner (see FIGS. 2, 3, and 4). At the beginning, roller 4 and knife 5 are in positions remote from mandrel 2. Closed reel 3 is fitted on mandrel 2. An arcuate blade-spring 12 controlled by a jack 13 comes to rest against reel 3, and roller 4 is brought into contact with the peripheral surface of reel 3. Knife 5 is then displaced in a direction parallel to the axis of reel 3 so that the cutting edge 14*a* of a blade 14, placed radially, severs a Bristol board closing strip 3*a* of reel 3 and a few of the outer turns of a paper strip 3*c* wound in successive turns to form reel 3. When this has been done, knife 5 is returned to its retracted starting position. The cut-off elements form scraps 3*b* (FIG. 3) which are held by spring-blade 12 and roller 4. The latter is then driven rotatingly while spring-blade 12 moves away slightly, and reel 3 starts rotating slowly in the direction indicated by arrow 3*d*. At the same time, device 8 goes into operation. Device 8 is shown in FIG. 1 in an inactive position. In FIG 3 and FIG. 4 (solid line) it is shown in an active position. Its inlet 15 is situated in immediate proximity to roller 4 at the location which cutting edge 14*a* has just left, so that the ends of scraps 3*b* are drawn into a duct 16, 17 formed by a bent tube 16, pivoted on a connecting piece 18 coaxial with the bend, and by a telescopic extension 17, the free end of which constitutes inlet 15. Connecting piece 18 is joined to an exhaust and to a suction blower so that scraps 3b are immediately carried off. The leading end (FIG. 4) of the last non-severed turn 3c of the strip forming reel 3 also enters inlet 15 of device 8 under the influence of the suction current, and by the time scraps 3b have been exhausted, it has penetrated several decimeters into extension 17. Thus end 3c of the strip is straightened out so that it can be precisely grasped.

The following operation consists in depositing the strip on presentation component 9 which is then in retracted position, as will be seen below. Telescopic extension 17 is moved into tube 16 by means of jack 20, thus freeing the location of component 9. The latter advances into active position, while tube 16 is driven so as to pivot in connection piece 18, being acted upon by another jack 21, the cylinder of which is hinged to the main frame of the apparatus (see the position shown in phantom in FIG. 4). As a result, strip section 3c is flattened against component 9, which has reached its advanced position. Suction nozzle 10 comprises a notch 22 situated facing a slot in component 9 in which a cutter blade 23, controlled by a jack 24, is embedded. The last operation in the method therefore consists in actuating jack 24. Blade 23 cuts strip 3c in such a way that the end of it is situated, precisely enough, facing notch 22; this also results in releasing the end of section 3c already previously introduced by suction into duct 16, 17 of suction device 8.

After the above operations, suction nozzle 10 is lifted off the flat top surface of presentation component 9. Component 9 is allowed to return to its starting position, whereas suction device 8 is returned to the position shown in FIG. 1. The conveyor can therefore be controlled and bring the leading edge of strip 3c, which has been fixed to nozzle 10 as stated hereabove, said nozzle forming a holding means for the leading end of the strip, exactly to the required location for its attachment to the trailing end of a strip already engaged in the cigarette- or filter-manufacturing machine.

FIGS. 5–9 show in more detail the different elements of the apparatus and explain the sequence of the method.

Mandrels 2, 2a, etc., intended to support reels 3, are mounted on a horizontal slide rail 1. These elements may be seen in FIG. 1 and will not be described in further detail here.

FIGS. 5 and 6 show slide 7 bearing carriage 6 on which roller 4, on the one hand, and knife 5, on the other hand, are mounted. Slide 7 is fixed against a vertical wall 30 supporting the device as a whole. As may be seen in FIG. 6, slide 7 comprises a guide rail 25 which extends obliquely upward and on which the base 26 of carriage 6 is mounted. This base comprises in particular an arbor 27 supporting roller 4, coupled to a drive shaft which is in turn integral with the rotor of motor 28. For moving carriage 6 on slide 7, the apparatus comprises a jack 60 (FIG. 5), the cylinder of which is fixed to a bracket 29, fixed in turn to vertical wall 30 bearing slide 7. The movable part of jack 60 comprises a rod 31 which is rigidly joined to base 26. The jack being oriented parallel to slide 7, controlling it in one direction or the other displaces carriage 6 by moving it away from or closer to the periphery of a reel 3 mounted on mandrel 2. Roller 4 has a cylindrical shape, and its axial length is 10 mm greater than the width of the paper strips 3c constituting reels 3. The required detector elements are provided on carriage 6 for checking the operation of jack 60. When the latter receives an order controlling a displacement of carriage 6 from a position remote from a reel toward this reel, this movement is interrupted at the moment when roller 4 rests against the periphery of the reel at the required pressure. As has been seen above, the reel is then still provided with its closing protector.

Knife 5 is mounted on base 26. For this purpose, the latter has one end in the form of a bracket 26a(FIGS. 6 and 7) to which the cylinder of a jack 32 is fixed, oriented parallel to slide 7. The rod 33 of this jack bears a cutting block 34 made up of a parallelepiped-shaped part provided with an undercut in which there are mounted two coaxial ball-bearing rollers 35 and 36 and, between these rollers, blade 14 already mentioned. This blade is octagonal. These elements are fixed in the block 34 by means of a screw 38, and means are provided for adjusting the position of blade 14 so that one of its straight edges 14a (FIG. 7) is oriented parallel to the axis of reel 3 and projects by a predetermined distance beyond the periphery of rollers 35 and 36.

To ensure the guidance and transmission of force necessary for cutting the reel, block 34 has a bore 40 in which a guide rod 41 is force-fitted and slides in a portion in the form of a sleeve 42 integral with bracket 26a.

As may be seen in FIG. 6, when jack 32 is in its retracted position, the whole of block 34 is in the clear relative to the width of reel 3. It will nevertheless be realized (see FIG. 7) that if jack 32 is actuated so that rod 33 moves from right to left, as viewed in the drawing, blade 14 enters the peripheral zone of reel 3 and cuts in the latter a kerf extending along a generatrix of the cylindrical outside surface of this reel.

As stated above, blade 14 will be adjusted so that during this movement, the peripheral belt which closes reel 3 in its state of presentation is cut through its entire thickness and that a number of turns of the strip of paper are severed besides. The position of blade 14 may be adjusted within a few tenths of a millimeter, so that the number of turns cut may be determined quite accurately and comprises, in fact, about five or six turns. The exact position of blade 14 at the moment of the cutting movement is likewise to be seen in FIG. 5, where it will be noted that the periphery of reel 3 is cut radially, block 34 being guided by sleeve 42.

FIG. 5 also shows certain elements of suction device 8, especially the outside end of tubular extension 17 and suction tube 16 in which the tubular extension is fitted. In the vicinity of its end, tube 16 has a slot 43 into which a lateral finger 44 fixed to the side of tubular extension 17 can fit. This lateral finger is integral with a rod 45 joined in turn to the piston of jack 20 fixed laterally against tubular element 16. As will be seen, suction device 8 can move between two end positions by rotation about the axis of connection piece 18, and these two positions are shown in FIG. 5. The angle they form between them is of a few degrees. In one of these positions, the axis of tubular section 16 is parallel to slide 7; and by actuating jack 20, opening 15 of tubular extension 17 may be brought into immediate proximity to the periphery of reel 3. Thus, once blade 14 of knife 5 has severed the reel, block 34 is withdrawn into the starting position shown in FIG. 7, after which opening 15 of tubular extension 17 is brought into a position immediately below roller 4. It is at this moment that the suction is turned on and that roller 4 is driven owing to the energizing of its motor 28. It will be understood that all the cut sections move in the direction from left to right, as viewed in FIG. 5, and that their ends drawn in by device 8 enter inlet 15, whence these sections are exhausted toward an outlet. At the same time, the free end of the last non-severed turn enters section 17 and hovers within this section. Once the scraps have been eliminated, extension 17 is retracted into tube 16 by actuation of jack 20; and as reel 3 has rotated through a certain angle, leading end 3c of the paper strip has advanced within the suction device and extends freely between roller 4 and opening 15, which is then situated in the position shown in dot-dash lines in FIG. 5.

At this moment, presentation component 9 goes into action. This presentation component is shown in detail in FIGS. 5, 8, and 9. In FIG. 8, particularly part of wall 30 is seen, which comprises a circular aperture 47 in which a disk 48 supporting the whole of component 9 is fixed. This disk in turn has a central aperture in which there is mounted a sleeve 49 supporting a jack 50, on the one hand, and two guide rods 51 and 52, on the other hand, which are mounted in positions parallel to the axis of jack 50. Rod 53 of jack 50 is fixed to a presentation block 54, which is in turn fixed to rods 51 and 52 sliding in sleeve 49. Presentation block 54 has a central slot 55. Fixed to the base of block 54 is a small jack, the rod (FIG. 9) of which bears a cutter blade. This is the jack 24 mentioned earlier, the rod 57 of which bears and controls cutter blade 23. This blade has an oblique edge and is capable of sliding in slot 55 when jack 24 is actuated. It is further apparent that presentation block 54 has a top face 59 which is flat and which extends horizontally (FIG. 5). On the other hand, this flat face 59 is prolonged toward reel 3 by an angle bracket 37 fixed to the side of block 54 facing reel 3 (FIG. 5). When the free end of the strip forming reel 3 has entered extension 17, and the latter has been retracted into the position shown in dot-dash lines in FIG. 5, the presentation component, which until then had been in retracted position, is advanced by operation of jack 50 and comes into the position shown in solid lines in FIG. 8. At that moment, returning to FIG. 5, it is seen that a counter-clockwise rotation of suction device 8 brings the free section of the strip, which is hovering between roller 4 and suction device 8, to assume a position immediately above flat surface 59. This position is detected by a sensor. When it is reached, the drive of roller 4 is cut off. The portion of strip 3c which was hovering above surface 59 comes to rest on that surface. Thus the space situated above presentation component 9 is free, and suction nozzle 10 of the conveyor means can assume a position immediately above block 54 so that notch 22 is aligned with slot 55. At that moment, jack 24 is controlled, and blade 23 cuts strip 3c so that its leading end is exactly opposite the edge of slot 22 relative to suction nozzle 10. In this way, the end of strip 3 is positioned absolutely precisely relative to the conveyor means which is to effect the attachment of this strip to the preceding strip and its introduction into the cigarette-manufacturing machine. Thereafter, as described earlier, the suction device is lifted by controlling jack 21.

When the conveyor means is moved, presentation component 9 is returned to its starting position roller 4 resumes operation so as to cause reel 3 to rotate about its axis and to unwind the strip at the required rate. The speed of rotation of this roller is regulated by the control of motor 28. It may be checked by the required detecting and regulating devices. Carriage 6 may move along slide 7 as the strip is unwound so that roller 4 continues to rest against the periphery of the reel at the required pressure. However, during the course of unwinding of the reel, the function of roller 4 becomes superfluous, and unwinding of the strip can be regulated simply by a brake acting upon mandrel 2. At that moment, carriage 6 may be withdrawn into its upper position (FIG. 5), and if need be, mandrel 2 may even be moved along rail 1 to reach, for example, the position of mandrel 2a as shown in FIG. 1. Hence a new mandrel 2 may be brought to the location shown in FIG. 1. The apparatus is then ready for the opening and insertion of a new reel, and all these operations can take place automatically and be mechanized.

As has already been stated, all the moving parts, which, except for roller 4, are driven by jacks, are provided with position or force detectors so that the automatic control device can check whether all the movements are carried out properly at the required moment, thus ensuring the sequences of different operations as described above and the setting off of warning devices or alarm signals in case of faulty operation.

What is claimed is:

1. Apparatus for opening a closed reel of a strip wound in successive turns, comprising:
   - means for supporting the reel for rotation about a fixed axis at a predetermined location,
   - a roller for driving the reel having an axis parallel to the axis of the reel,
   - a knife assembly having a straight knife edge parallel to the axis of the reel, and movable to cut a plurality of turns of said strip, thus forming scraps and a leading edge of said strip,
   - a movable carriage bearing said roller and said knife assembly,
   - a fixed slide bearing said carriage,
   - suction and exhaust means, having a movable inlet able to be placed in proximity to said roller, and arranged for sucking in through said inlet the scraps cut from said strip by said knife, and for straightening the leading end of said strip, and
   - a movable holding member for fixing said straightened leading end of said strip.

2. The apparatus of claim 1, further comprising means for adjusting the position of said knife edge relative to the axis of the reel.

3. The apparatus of claim 1, wherein said suction and exhaust means comprises:
   - a section of tubing and means for supporting said section of tubing at the end thereof remote from said means for supporting the reel, said section of tubing being rotatable about an axis parallel to the axis of the reel,
   - a telescopic extension piece aligned with said section of tubing, having one end facing the reel, and including an inlet opening at said one end, and
   - means for imparting a translatory motion to said telescopic extension piece within said section of tubing and for rotating said section of tubing about said axis parallel to the axis of the reel.

4. The apparatus of claim 1, wherein said knife assembly comprises a knife support, two ball-bearing rollers disposed on said knife support, and a knife blade in the shape of a regular polygon mounted between said ball-bearing rollers on said knife support in such a way that one of the sides of said polygon forms said knife edge.

5. The apparatus of claim 1, further comprising:
   - a plurality of force detectors and position detectors for checking the movement of said knife assembly, said movable carriage, said movable inlet and said movable holding member; and control means receiving signals from said detectors for actuating said knife assembly, said movable carriage, said movable inlet and said movable holding member according to a predetermined program.

6. The apparatus of claim 1 wherein said movable holding member in a suction nozzle.

7. The apparatus of claim 6, further comprising a presentation component having a flat top surface and wherein said movable inlet is driven to place said straightened leading end against said component.

8. The apparatus of claim 7, wherein said presentation component and said knife assembly are movable independently of one another in directions parallel to the axis of the reel between a retracted position and an advanced position.

9. A method of opening a reel made of a strip of paper wound in successive turns and for engaging a leading end of the strip in a production machine, comprising the steps of:

mounting the closed reel on a mandrel, cutting a peripheral zone of the reel along a line parallel to its axis, eliminating one or more cut segments and straightening the aforementioned leading end by suction, and fixing this straightened leading end to a conveyor means, all these operations being mechanized.

10. The method of claim 9, comprising the further steps of holding the reel in a fixed position during the cutting of the peripheral zone, then driving the reel rotatingly about the axis of the mandrel for eliminating cut-off sections and for straightening the leading end of the strip.

11. The method of claim 9, wherein the fixing of the straightened leading end of the strip to a conveyor means is effected by means of a suction nozzle integral with a movable component of the conveyor and capable of fixing a surface portion of the strip by suction.

12. The method of claim 9, comprising the further steps of driving a roller by means of a motor and controlling a rotary movement of the reel about the axis of the mandrel by means of the roller, the roller being moved toward the reel to rest radially against the reel after the mandrel has been put in place.

* * * * *

UNITED STATES PATENT AND TRADEMARK OFFICE

CERTIFICATE OF CORRECTION

PATENT NO. : 4,995,406

DATED : February 26, 1991

INVENTOR(S) : Domingos da Silva

It is certified that error appears in the above-indentified patent and that said Letters Patent is hereby corrected as shown below:

On title page, item [56] add the following:

-- OTHER PUBLICATIONS

"Paper Transport Mechanism", IBM Technical Disclosure Bulletin, vol. 15, no. 8, Jan. 1973, p. 2378 ..... 271/310

"Paper Detach Device", IBM Technical Disclosure Bulletin, vol. 15, no. 12, May 1973, p. 3651 ..... 271/310 --.

Signed and Sealed this

Twenty-second Day of March, 1994

Bruce Lehman

*Attest:*

BRUCE LEHMAN

*Attesting Officer*

*Commissioner of Patents and Trademarks*